US007222864B2

(12) United States Patent
Giering, Jr.

(10) Patent No.: US 7,222,864 B2
(45) Date of Patent: May 29, 2007

(54) APPARATUS AND METHOD FOR DETERMINING THE CORRECT STANCE FOR RIDERS OF BOARD-TYPE TITLE CONVEYANCES

(76) Inventor: George Giering, Jr., 2655 State St., Hamden, CT (US) 06517

( * ) Notice: Subject to any disclaimer, the term of this patent is extended or adjusted under 35 U.S.C. 154(b) by 86 days.

(21) Appl. No.: 11/131,214

(22) Filed: May 18, 2005

(65) Prior Publication Data

US 2006/0279050 A1 Dec. 14, 2006

(51) Int. Cl.
*B62B 9/04* (2006.01)
*B62B 13/00* (2006.01)

(52) U.S. Cl. ..... 280/14.22; 280/14.24; 280/14.21; 280/617; 280/618

(58) Field of Classification Search ..... 280/618, 280/617, 607, 613, 14.22, 14.24, 633, 14.21, 280/616, 632, 631
See application file for complete search history.

(56) References Cited

U.S. PATENT DOCUMENTS 4,964,649 A * 10/1990 Chamberlin ..... 280/618
5,028,068 A * 7/1991 Donovan ..... 280/618
5,085,455 A * 2/1992 Bogner et al. ..... 280/618
5,732,959 A 3/1998 Soejima
5,820,155 A * 10/1998 Brisco ..... 280/607
5,947,488 A * 9/1999 Gorza et al. ..... 280/14.21
6,029,991 A * 2/2000 Frey ..... 280/618
6,065,768 A * 5/2000 Lee ..... 280/613
RE36,800 E * 8/2000 Vetter et al. ..... 280/618
6,279,924 B1 * 8/2001 Murphy et al. ..... 280/14.23
6,318,749 B1 * 11/2001 Eglitis et al. ..... 280/607
6,450,511 B1 * 9/2002 LaVoy ..... 280/14.22
6,467,794 B1 * 10/2002 De France ..... 280/607
6,499,760 B1 * 12/2002 Tindall et al. ..... 280/618
6,916,036 B1 * 7/2005 Egli ..... 280/618
6,923,454 B2 * 8/2005 Drako ..... 280/14.24

* cited by examiner

*Primary Examiner*—Hau Phan
(74) *Attorney, Agent, or Firm*—Sherman & Associates

(57) ABSTRACT

The present invention is directed to an apparatus and method for determining a custom fit stance for the user of a board-type conveyance such as a snowboard, wake board, or the like. The apparatus comprises a housing having top, bottom, front, back and side walls defining a space within, leveling means extending downward from the bottom of the housing and an anti-slip surface on the top of the housing, at least one plate linearly translatable across a portion of the top of the housing and having a first binding mounting plate separately radially rotatable thereon, a second binding mounting plate spaced from the linearly translatable mounting plate and radially rotatable relative to the housing and separate and independent of the first binding mounting plate, means for separately and independently rotating the first binding mounting plate and the second binding mounting plate, and means for linearly translating the movable plate and the first binding mounting plate relative to the second binding mounting plate.

20 Claims, 8 Drawing Sheets

APPARATUS AND METHOD FOR DETERMINING THE CORRECT STANCE FOR RIDERS OF BOARD-TYPE TITLE CONVEYANCES

FIELD OF THE INVENTION

The present invention is directed to an apparatus and method, the purpose of which is to establish a means of designating a custom fit stance for the user of a board-type conveyance such as a snowboard, wake board, or the like. This will reduce the risk of injury to the lower extremities and increase the user's performance. The apparatus and method are particularly applicable to use with snowboards.

BACKGROUND OF THE INVENTION

A stance represents the way a snowboarder stands on his/her snowboard that should be comfortable, natural and stable. The stance determines the way the bindings mount onto the snowboard according to personal preference. A snowboarder's stance is comprised of three variables: the angle of the left foot, the angle of the right foot and the distance between the feet. By determining a custom fit stance to reduce abnormal stresses on the knees and ankles, the rider may feel more comfort on the board before setting foot on the mountain.

Currently there is no means of designating a custom fit stance to a customer for his/her newly purchased or rented snowboard. The rental shop provides a board according to the customer's height, weight, and favored foot. The bindings are situated randomly, disregarding his/her lower physiology. Even when the customer buys a brand new board, the shops rarely set the board up for the customer's individual physiology. Rookie snowboarders are constantly sent out onto the slopes without any stance knowledge.

Everyone's lower physiology is different. Mathematically there are hundreds of thousands of ways to mount the bindings to the board. Even the different styles of boots and bindings can affect the users' stance. The snowboard market needs the convenience of a device that simulates the typical snowboard, yet is capable of manipulating the foot placement while the customer is on the device with his/her feet in a chosen set of bindings. The device must allow the user to adjust the binding stance according to the individual's comfort and stability on the board. The stance positioning must be easily measured quantitatively and transformed into dimensions that can be used to mount the bindings onto the board in the same position. Being able to adjust the angles of each individual foot and the width between the feet into a comfortable position will maximize the rider's performance and confidence while minimizing the loading on the joints, thus preventing injury.

Currently, U.S. Pat. No. 5,732,959 Soejima discloses a method for positioning bindings to be fitted to a snowboard and a device therefore. The device comprises a snowboard shaped base with a pair of binding mounting discs thereon. However we note that the device only provides for determining and adjusting the rotational or axial deviation. There is no provision for determining a longitudinal position (stance width) for the bindings. With regard to longitudinal spacing between left and right foot bindings on a snowboard, prior art teaches such adjustment when bindings are actually mounted onto the board not on a measuring device prior to actually mounting the bindings on the board.

The angles of the left and right feet are very important for mounting the bindings onto the snowboard. But the distance between the feet is essential for proper stance configuration. Soejima clearly overlooked this concept. Foot angulations will change if the distance between the feet changes. Foot angles are directly proportional to the angle between the upper legs (femur bones). As the angle between the femur bones increases, the stance width increases. The lower leg remains at a fixed position in relation to the respective femur, translating into the angular position of the respective foot. As the distance between the feet increases, there will be an increase in external (lateral/outward) rotation of both feet. Angle of the foot is dependant upon the rotation of the hip. The distance between the feet can range from roughly 15" to 24" so the foot angulations will change respectively. Soejima does not take into consideration that the angles of the left and right feet are a direct function of the distance between the feet.

SUMMARY OF THE INVENTION

The device of the present invention will allow for intuitive testing of a person for their proper stance. The subject must designate whether he/she is right or left footed in order to determine a regular (left foot forward) or goofy stance (right foot forward). The subject's bindings will be mounted to the device. With boots tied to his/her feet, the subject stands on the device, straps into his/her bindings and begins with a stance width that is shoulder width apart, the average of the maximum stance and the minimum stance (for optimal side to side stability). The rider should look in the downhill direction (over the right or left shoulder depending on stance) and bend the knees slightly. The feet should be spread to a distance comfortable to the rider at several different degrees of flexion.

Once a reasonable stance width is found, the angles of the feet should be adjusted. The feet angles are moved outwards at any given increment until comfortable knee bending can occur through 90 degrees of flexion. The subject should bend his/her knees slightly while looking in the downhill direction and notice any uncomfortable stresses throughout the lower extremities. In an improper stance, the feet naturally turn inward or outward and press against the side of the boot, preventing the foot from turning. As a result the leg is twisted, producing a torque-like stress on the ankle and up to the knee. Adjusting the foot angle in the appropriate direction to relieve the pressure point reduces this stress.

For freestyle riding, negative rear foot angles or those close to 0 degrees are preferred while higher angles are preferred for carving. Further testing may be required on the mountain to determine if centering or offsetting the stance on the board optimizes stability, comfort and mobility.

The following list highlights the important concepts when determining a proper stance:

Maximum stability in all directions. The rider will tend to be least stable in the direction perpendicular to where the feet point when the rider's feet are placed close together. Also, for larger bases of support there will be better distribution of the body weight between the two legs and therefore, more stability. Large stance widths will yield a large base of support thus being more stable. On the other hand, a stance that is too wide will hinder knee bending and proper weight transfer.

Maximum mobility. In order to perform maneuvers, the rider needs to be able to shift his/her center of gravity from side to side. This becomes harder as the stance width increases.

A knee flexion angle of 90°. The ability to bend the knees to 90° flexion is important for both mobility and stability.

The knees act as a spring for absorbing the energy of impact. The less flexion allowed, the greater the risk of injury at impact. The stance angle and stance width both limit flexion.

Maximum comfort. Comfort is the most important factor to consider. If the rider experiences initial tension in the muscles or joints in a basic stance, there is greater risk of serious injury when the joints are set in motion. Minimizing the loads by adjusting to a comfortable stance will lead to maximum comfort.

The design of the device stems from the idea of creating a custom fit stance to accommodate every rider's physiology. Many design criteria fit into the development of the device. The mechanism must accommodate both regular and goofy (right and left respectively) footed riders and securely support the weight of the rider with his/her equipment while successfully representing a real snowboard. The use of universal components in the device guides many decisions in the design for simplicity. An internal structure provides linear motion and radial motion. Digital/analog outputs give dimensions to the three variables of the stance.

In particular, the present invention presents an apparatus for determining the correct stance for snowboarders and mounting position for bindings comprising: a housing having top, bottom, front, rear and side panels and defining a space within, at least one movable plate linearly translatable across the top of the housing, a first binding mounting plate on the movable plate, a second binding mounting plate fixed to the top of the housing and laterally spaced from said the binding mounting plate, the first and second binding mounting plates being radially rotatable about vertical axes therethrough, and means for independently rotating the first and second binding mounting plates and means for linearly translating the movable plate relative to the second binding mounting plate, whereby lateral spacing and rotational angles of left and right foot bindings corresponding to the correct stance for a snowboarder are determinable and transferable to a snowboard.

The present invention further provides an apparatus and for determining a custom fit stance for the user of a board-type conveyance such as a snowboard, wake board, or the like wherein the apparatus comprises a housing having top, bottom, front, back and side walls defining a space within, leveling means extending downward from the bottom of the housing and an anti-slip surface on the top of the housing, at least one plate linearly translatable across a portion of the top of the housing and having a first binding mounting plate separately radially rotatable thereon, a second binding mounting plate spaced from the linearly translatable mounting plate and radially rotatable relative to the housing and separate and independent of the first binding mounting plate, means for separately and independently rotating the first binding mounting plate and the second binding mounting plate, and means for linearly translating the movable plate and the first binding mounting plate relative to the second binding mounting plate.

In addition, the present invention provides a method for determining a custom fit stance for a user of a board-type conveyance having foot bindings thereon and for determining correct placement of the bindings on the conveyance for the user, comprising: providing an apparatus comprising a housing having top, bottom, front, back and side walls defining a space within, leveling means extending downward from the bottom of the housing and an anti-slip surface on the top of the housing; at least one plate linearly translatable across a portion of the top of the housing and having a first binding mounting plate separately radially rotatable thereon; a second binding mounting plate spaced from the linearly translatable mounting plate and radially rotatable relative to the housing and separate and independent of the first binding mounting plate; means for separately and independently rotating the first binding mounting plate and the second binding mounting plate and means for linearly translating the movable plate and the first binding mounting plate relative to the second binding mounting plate; determining the user's leading foot; temporarily securing a set of foot bindings for a board-type conveyance to the binding mounting plates; placing the user's feet into the bindings; while the user is standing on the apparatus, adjusting the rotational angle of each of the first and second binding mounting plates and the linear separation of the first and second binding mounting plates relative to the user's lower body physiology, whereby abnormal stress and rotation of the user's legs is reduced or eliminated; determining the particular angle of rotation for each foot and the linear separation therebetween; and transferring the angles and separation to a board-type conveyance whereby the bindings are removed from the apparatus and mounted on the board-type conveyance at the indicated angle and separation.

It is therefore an object of the present invention to provide an apparatus for determining a custom stance for a user of a board-type conveyance.

It is a further object to provide an apparatus for determining the correct placement of bindings on a board-type conveyance prior to the mounting of those bindings and to equate that placement with a custom stance for the user.

It is a still further object to provide a method and apparatus whereby the user of a board-type conveyance such as a snowboard can obtain an optimum custom stance for his or her style of riding, determine the correct spacing and angular relationship of foot bindings for that stance and transfer that spacing and angular relationship to the board when mounting the bindings thereon.

These and additional objects and advantages will become evident from the following description and drawings.

DETAILED DESCRIPTION OF THE INVENTION

Figure 1:
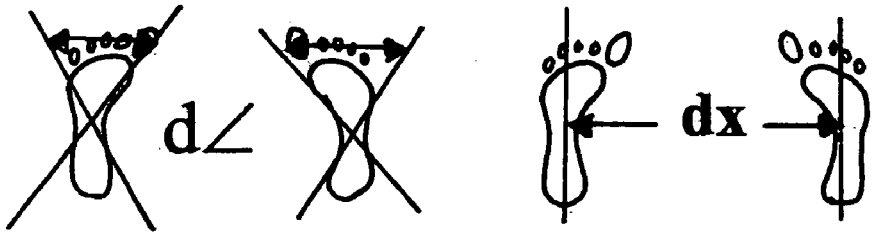
FIG. 1. illustrates the angular and linear relationships of the feet in accordance with the present invention.

FIG. 1 illustrates the angular and linear relationships of the feet as they apply to riding of snowboards and similar board-type conveyances. The comfort and effectiveness of a rider's stance are affected by the spacing between the feet, dx, and the angle, d<, of each foot in relation to the spacing. This applies whether the rider has a regular or goofy footed stance. Mounting bindings on a snowboard such that the rider does not have the correct stance for his style of riding and lower physiology, is at best uncomfortable for the rider thereby reducing the enjoyment of the sport, and at worst an incorrect stance can be dangerous in that it can easily result in injury to the legs, hips, knees and ankles.

Figure 2:
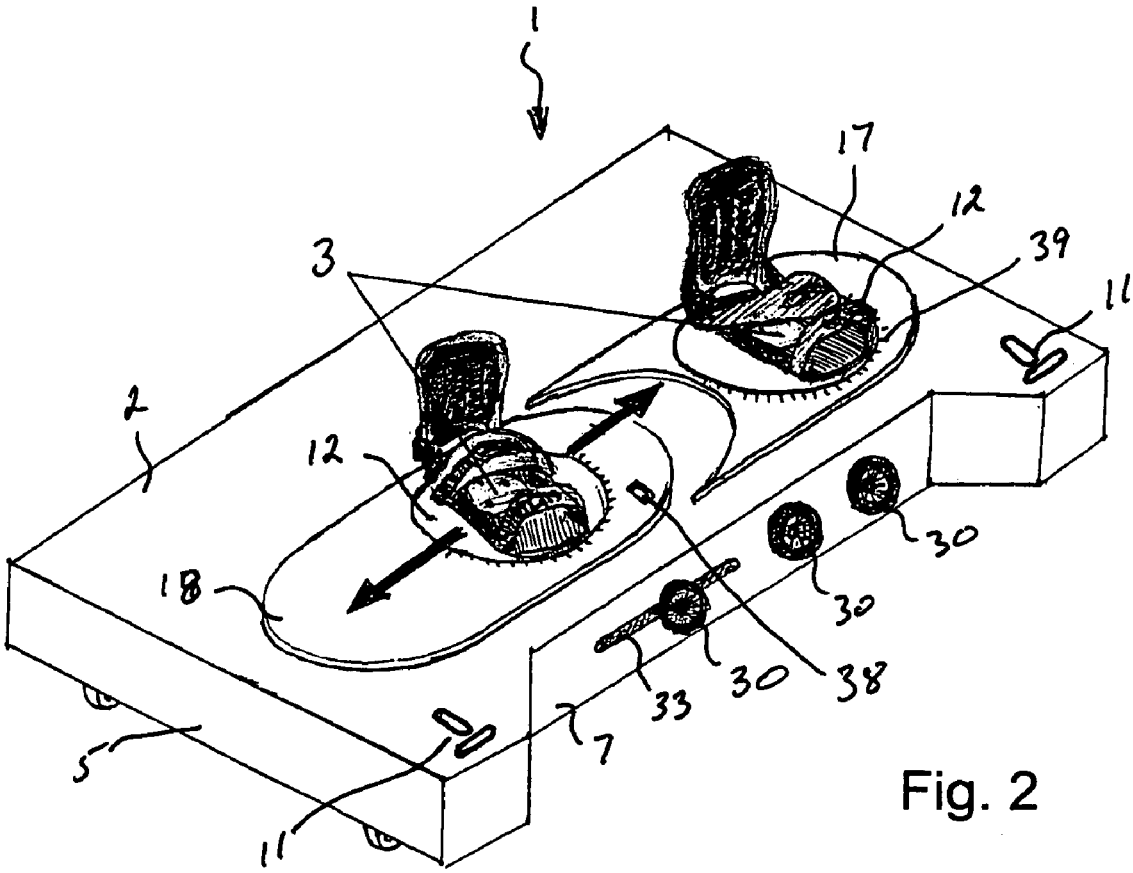
FIG. 2. is an oblique view of the apparatus of the present invention with a pair of snowboard bindings mounted thereon.
Figure 3:
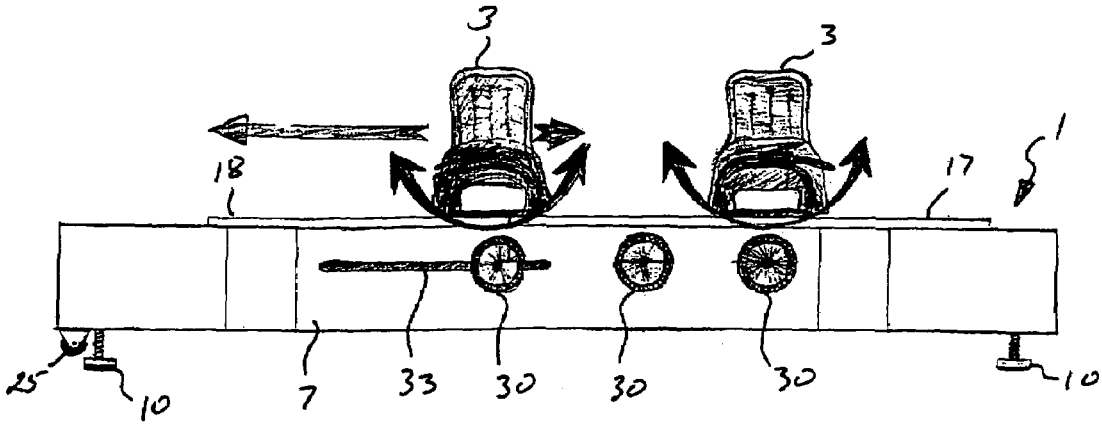
FIG. 3. is a front elevation of FIG. 2.

The apparatus of the present invention is shown in FIGS. 2 and 3 and is based around a sheet metal housing structure 1 with a top panel 2 designed to provide the look and feel of an actual snowboard. Sheet metal can be protected & accented with organic coatings and an anti-slip surface on the top platform 2. Supported by rigid stiffeners underneath, the platform offers plenty of area for the user to stand on while buckling into his/her bindings mounted to the device.

Figure 4:
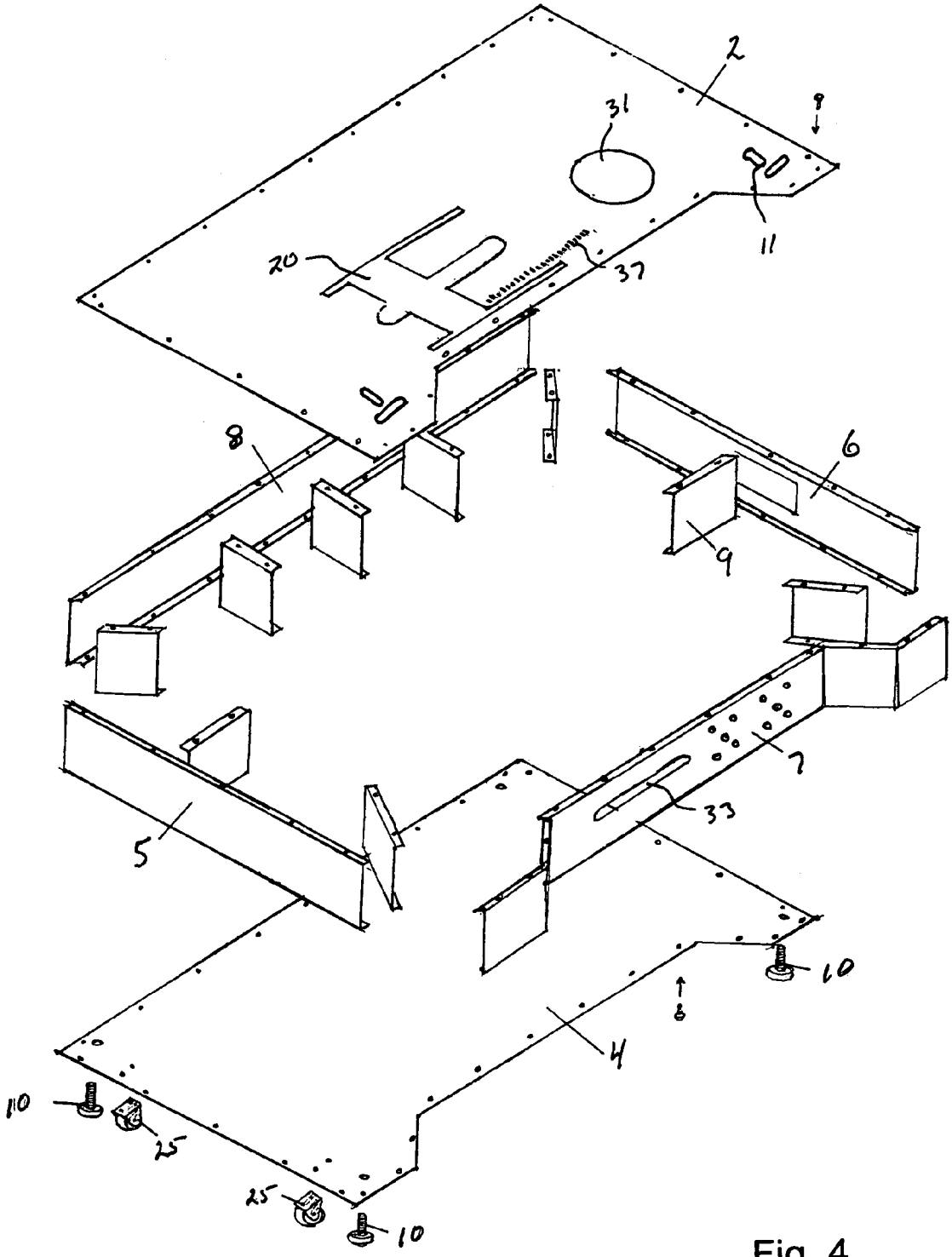
FIG. 4. is an exploded view of the housing of the apparatus.
Figure 5:
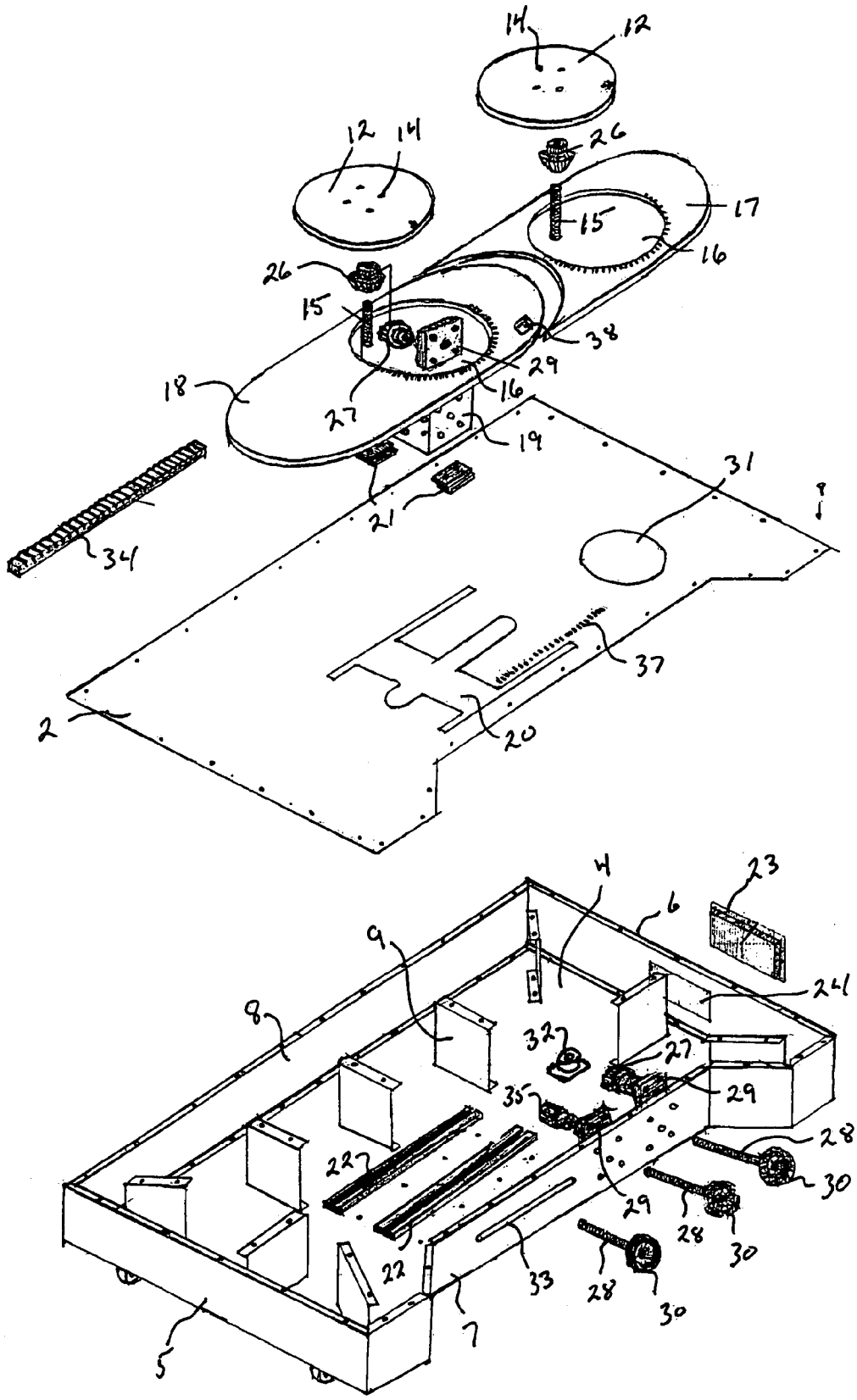
FIG. 5. is an exploded view of the apparatus illustrating the manual adjusting mechanism.
Figure 6:
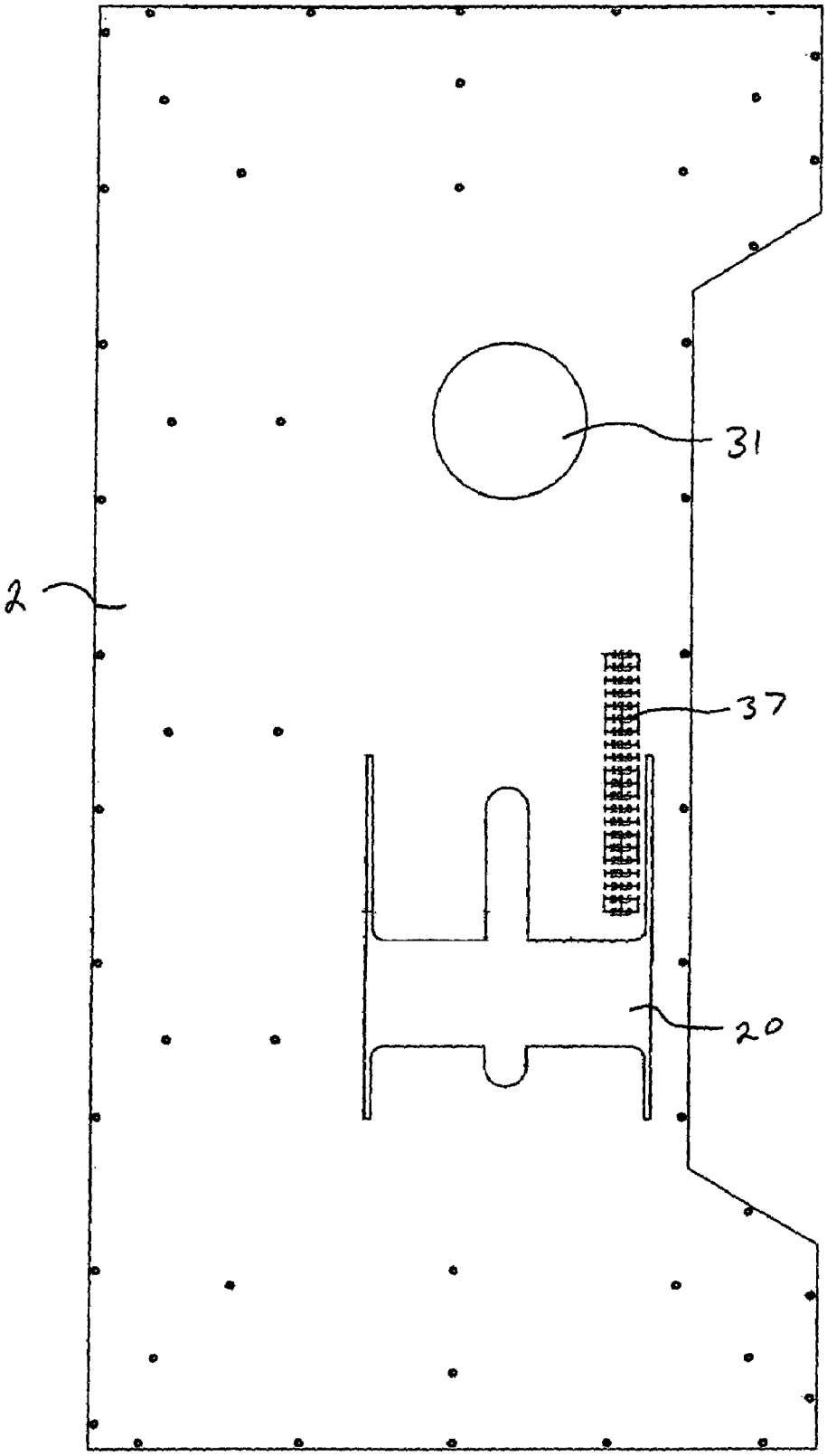
FIG. 6. is a plan view of the top of the housing.
Figure 7:
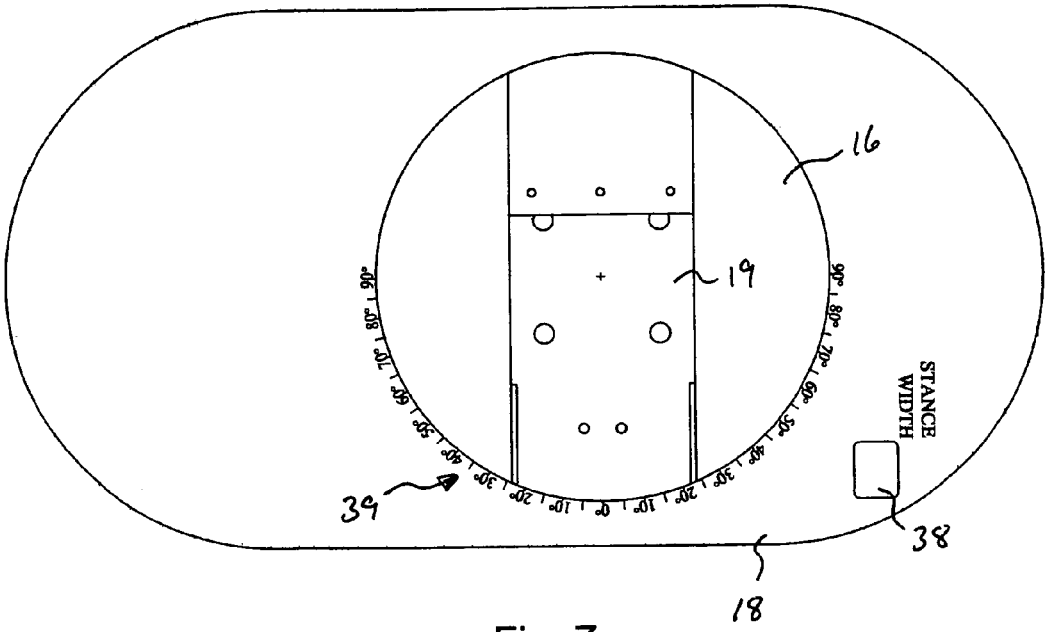
FIG. 7. is a plan view of the linearly translatable movable plate.
Figure 8:
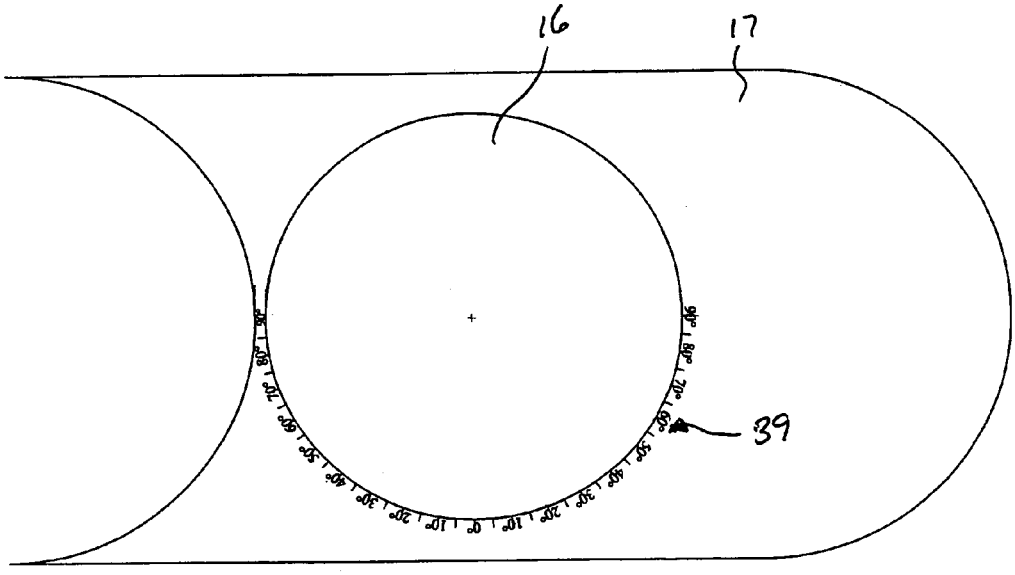
FIG. 8. is a plan view of a cosmetic plate for the second binding mounting plate.

Looking at FIG. 4, the housing 1 consists of the top 2, and bottom panels 4, left 5 and right 6 side panels, and front 7 and rear 8 panels assembled together with screws. Inner supports 9 assemble between top 1 and bottom 4 panels providing strength and rigidity to the housing 1. Top panel 2 is preferably coated with an anti-slip coating to increase traction while standing on the device. Bottom panel 4 sits on four leveling mounts 10 assuring even weight distribution and level stability of the device on most floor surfaces. Level indicators 11, such as bubble levels, may be included to assist the operator in leveling the device for use.

Figure 9:
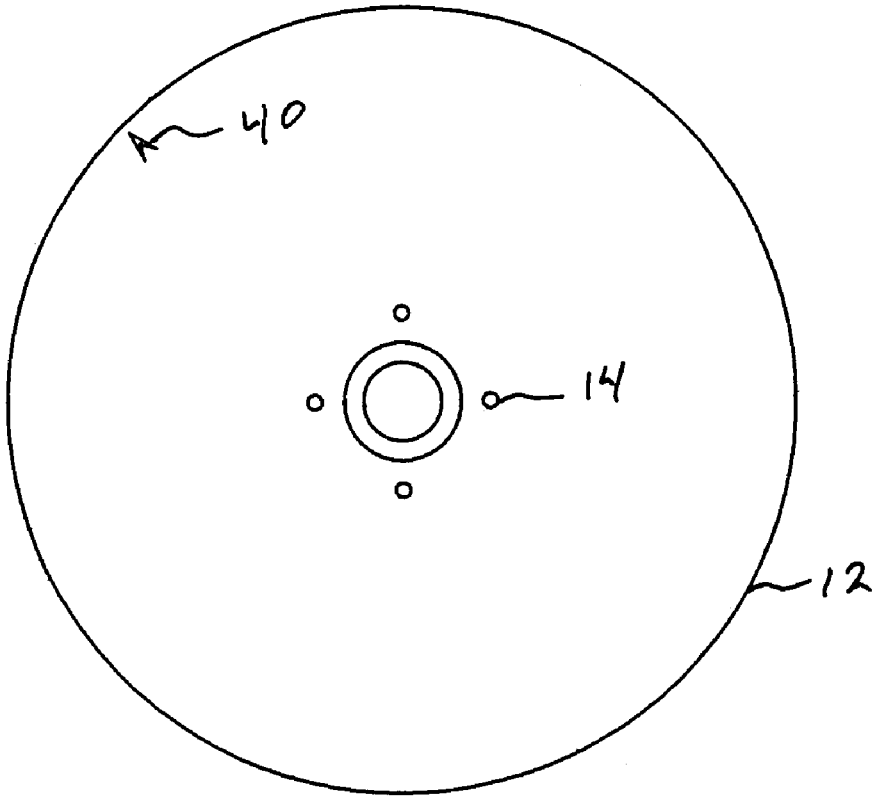
FIG. 9. is a top view of a binding mounting plate.
Figure 10:
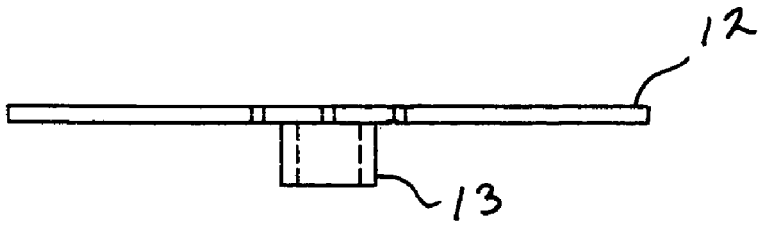
FIG. 10. is a side view of a binding mounting plate.

The user's bindings 3 fasten to two binding mounting plates 12 with four screws in the four hole pattern 14, which is standard for snowboard bindings. The binding mounting plates 12 are identical and are illustrated in FIGS. 9 and 10. Binding mounting plates 12 each have an axle 15 depending vertically therefrom, one end of the axle 15 being received and secured in a collar 13 located centrally on the underside of the binding mounting plate 12. One binding mounting plate 12 sits concentrically in a hole 16 in a cosmetic top 17 and the other sits concentrically in a hole 16 in the stance width mount 18. Cosmetic top 17 and stance width mount 18 lay on the upper surface of the top panel 2 and represent a snowboard shape. Cosmetic top 17 is fixed to top panel 2 with screws, whereas stance width mount 18 is provided with a bracket 19 on the underside that extends downward through an E-shaped aperture 20 in the top panel 2. Bearing means 21 located on the underside of bracket 19 engage rails 22 located on the inside of the bottom panel 4 below E-shaped aperture 20 and provide for smooth movement of stance width mount 18 back and forth. Bearing means 21 and rails 22 may be low friction material, or bearing means 21 may comprise wheels, ball bearings, roller bearings or other reduced friction rolling means cooperating with rails 22 to ease back and forth movement of stance width mount 18.

A recessed case-folding handle 23 mounts into a hole 24 in the right side panel 6. This handle 23 makes it easy to lift one end of the device so the other end sets onto two casters 25. The casters 25 allow the device to be conveniently rolled and placed in a desirable location.

Returning to the binding mounting plates 12, as noted, each has an axle 15 depending vertically therefrom and each axle is provided with a miter gear 26 secured thereto. In the case of the binding mounting plate 12 associated with cosmetic top 17, axle 15 and its miter gear 26 extend downward through an aperture 31 in top panel 2, which aperture 31 has a diameter no larger than that of binding mounting plate 12, into housing 1. The bottom end of axle 15 engages a bearing member 32 on the bottom 4 of housing 1 centrally located below aperture 31. In this manner, binding mounting plate 12 is supported for ease of rotation when the user is standing thereon. Miter gear 26 engages a corresponding miter gear 27 which is fixed to a shaft 28 horizontally disposed in a flange mount bearing 29 attached to the inside of front panel 7. Shaft 28 extends through front panel 7 and is provided with a knob 30 on its outer end.

Binding mounting plate 12 associated with stance width mount 18 has a similar axle 15, shaft 28, gears 26 and 27, flange mount bearing 29, knob 30 and bearing member 32 operating in the same manner, except that flange mount bearing 29 and bearing member 32 are located in bracket 19 so that binding mounting plate 12 and its operating mechanism are linearly movable with stance width mount 18 in addition to being able to rotate relative thereto. To accommodate such linear motion, shaft 29 of this assembly passes through a slot 33 in front panel 7 of housing 1. Bracket 19 is essentially a U-shaped piece secured to the underside of stance width mount 18 that passes through E-shaped aperture 20, the legs of the U-shaped piece being able to traverse through the upper and lower arms of E-shaped aperture 20 as stance width mount 18 traverses from left to right. The middle arm of E-shaped aperture 20 accommodates axle 15 of binding mounting plate 12.

A rack and spur gear system controls the left and right traversal of stance width mount 18 relative to cosmetic top 17. In this system, rack 34 mounted to bracket 19 is engaged by spur gear 35 that is fixed on an inner end of shaft 36. A flange mount bearing 29 is secured to the inside of front panel 7 for spur gear shaft 36 to pass through and a knob 30 is secured to outer end of shaft 36. Rotation of knob 30 on the end of shaft 36 causes spur gear 35 to rotatably engage rack 34, thereby causing stance width mount 18 to traverse left and right.

On the upper surface of top panel 2, adjacent to E-shaped aperture 20, are indicia 37 corresponding to the distance between the center points of binding mounting plates 12. As the stance width mount 18 is traversed left and right, the appropriate indicia is visible through window 38, thereby providing a direct indication of the stance width. Around the periphery of holes 16 in cosmetic top 17 and stance width mount 18 are indicia 39 designating the positive and negative angles obtainable by the binding mounting plates 12 of 0° to 90° on each side. Each binding mounting plate 12 is provided with an indicator mark 40 to designate the angular position.

Turning any of the three knobs 30 changes the stance settings. Thus, turning knob 30 associated with stance width mount 18 will cause it to traverse left or right, thus changing the width of the user's stance. Turning knobs 30 associated with the binding mounting plates 12 will rotate the plates 12 on their axles 15 thereby changing the foot angles. By manipulating the knobs 30, it is possible to obtain optimum stance settings for the user and, by noting the width and foot angle readings, to mount the bindings 3 on a snowboard so as to correspond to the settings and the stance determined using the apparatus of the present invention.

After appropriate adjustments are made and once the user is comfortable, the user's three stance dimensions—stance width, left foot angle & right foot angle—are determined from the respective measurement readings provided by the indicia on the device. Alternatively, electronic measurement means may be provided with an analog or digital display of the three criteria.

All mechanical motion and motion transfer components may be replaced or upgraded with electrical or electronic motion and motion transfer components. In addition, where the mechanical components are replaced with electrical or electronic means for adjustment, a wired or wireless remote control unit may be included with controls for adjusting the width and rotation so the customer may make the adjustments himself based on his own perception of the degree of comfort in the stance.

Figure 11:
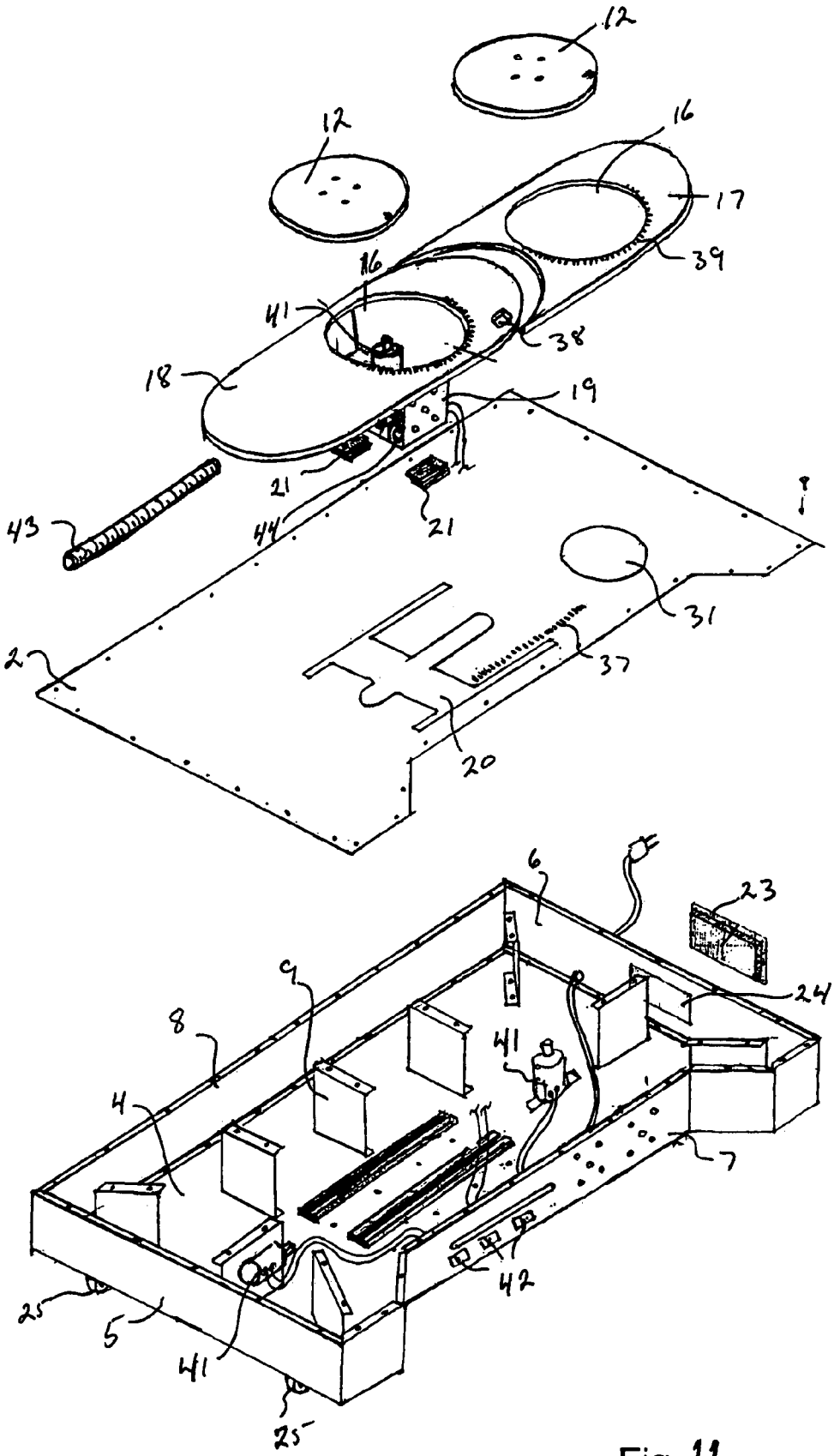
FIG. 11. is an exploded view of the apparatus illustrating a motorized adjusting mechanism.

In an example of such an alternative embodiment, the manual mechanical adjustment means described above may be replaced with motorized means such as that shown in FIG. 11. In this embodiment, electric motors 41 controlled by switches 42 or a remote control unit replace the gear and axle mechanisms of the binding mounting plates 12 and the rack and gear mechanism of the stance width mount 18. In the case of the binding mounting plates 12, vertically mounted reversible electric motors 41 provide rotational adjustment, the motor 41 for the binding mounting plate 12 associated with stance width mount 18 being located in bracket 19. For left and right traversal of stance width mount 18, a horizontally mounted reversible electric motor 41 drives threaded rod 43 that rotates within threaded follower 44 secured to bracket 19. Rotation of threaded rod 43 causes follower 44 to move linearly there along thereby causing stance width mount 18 to traverse left and right. Other arrangements of motors, actuators, controllers, and the like adapted to provide the linear movement of stance width mount 18 and the rotational movement of binding mounting plates 12 while a user is standing thereon may be used without departing from the scope of this invention.

The focus of the device is to predict a stance width and foot angle for an individual based on the loads experienced during snowboarding and pre-existing conditions of the individual's lower extremities. The device is engineered so a rider can stand on a representation of a snowboard device to position his/her feet in a pose that is most comfortable for the rider's lower extremities. This will decrease post snowboarding pains by eliminating abnormal strains in the lower extremities. Providing the rider with the most comfortable stance will also minimize the risk of injury and maximize the rider's performance.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. An apparatus for determining the correct stance for snowboarders and mounting position for bindings comprising:

a housing having top, bottom, front, rear and side panels and defining a space within, at least one movable plate linearly translatable across the top of said housing, a first binding mounting plate on said movable plate, a second binding mounting plate fixed to the top of said housing and laterally spaced from said first binding mounting plate, said first and second binding mounting plates being radially rotatable about vertical axes therethrough, and means for independently rotating said first and second binding mounting plates and means for linearly translating said movable plate relative to said second binding mounting plate, whereby lateral spacing and rotational angles of left and right foot bindings corresponding to the correct stance for the snowboarder are determinable and transferable to a snowboard.

2. The apparatus of claim 1 further comprising indicia identifying the lateral spacing of said first and second binding mounting plates and indicia identifying the rotational angles of said first and second binding mounting plates.

3. The apparatus of claim 2 further comprising means on said first and second binding mounting plates for removably receiving snowboard bindings.

4. The apparatus of claim 3 wherein said means for independently rotating said first and second binding mounting plates comprises a mechanical gear mechanism for each mounting plate, each said mechanism comprising a vertical axle mounted within said housing space and on which said mounting plate is secured, a first miter gear secured to said vertical axis, a horizontal axle mounted within said housing space and extending through said front panel, a second miter gear secured to said horizontal axle and engaging said first miter gear, whereby axial rotation of said horizontal axle is transferred to said vertical axle and said mounting plate by said engaging miter gears.

5. The apparatus of claim 4, wherein said means for linearly translating said movable plate comprises a rack mounted to the underside of said plate and a spur gear mounted on an inner end of a horizontal axle extending through said front wall of said housing, said spur gear engaging said rack, whereby rotation of said spur gear on said axle is transferred by engagement with said rack into linear motion whereby said plate is caused to translate linearly across said housing top relative to said second binding mounting plate.

6. The apparatus of claim 5 further comprising at least one track mounted on said housing bottom within said housing space and below said movable plate and bearing means mounted to the underside of said plate engaging said track, wherein said bearing means are selected from low friction material slider bearings, wheels, ball bearings or roller bearings.

7. The apparatus of claim 5 further comprising an electric motor connected to and driving said horizontal axle and control means therefor, whereby translation of said movable plate is independent of rotation of said first and second binding mounting plates.

8. The apparatus of claim 4 further comprising electric motors connected to and driving said horizontal axles and independent control means therefor, whereby rotation of said first and second binding mounting plates is independent and separate.

9. The apparatus of claim 3 wherein said means for independently rotating said first and second binding mounting plates and for linearly translating said movable plate comprise three reversible electric motors mounted within said housing space, a first electric motor adapted to linearly translate said movable plate across the top of said housing, a second electric motor adapted to rotate said first binding mounting plate, and a third electric motor adapted to rotate said second binding mounting plate, and control means for selectively and independently operating said electric motors.

10. An apparatus for designating a custom fit stance for a board-type conveyance having foot bindings comprising:

a housing having top, bottom, front, back and side walls defining a space within, leveling means extending downward from the bottom of said housing and an anti-slip surface on the top of said housing, at least one plate linearly translatable across a portion of the top of said housing and having a first binding mounting plate separately radially rotatable thereon, a second binding mounting plate spaced from said linearly translatable mounting plate and radially rotatable relative to said housing and separate and independent of said first binding mounting plate, means for separately and independently rotating said first binding mounting plate and said second binding mounting plate and means for linearly translating said movable plate and said first biding mounting plate relative to said second binding mounting plate.

11. The apparatus of claim 10 wherein said means for rotating said first and second binding mounting plates comprises separate manually operated geared transmission members comprising vertical axle shafts depending from said binding mounting plates and operating shafts extending outward of said housing, said axle shafts and said operating shafts having engaging gear members thereon whereby manual rotation of said operating shafts is transmitted to axle shafts whereby said binding mounting plates are radially rotatable about a central axis through the plane of the plate.

12. The apparatus of claim 11 wherein said means for linearly translating said movable plate and said first binding mounting plate thereon comprises a manually operated transmission comprising a toothed rack linearly mounted to the underside of said movable plate, a horizontal shaft extending outward of said housing and having a toothed gear thereon engagable with said rack whereby rotation of said shaft is transferred by engagement of said gear with said rack into linear motion whereby said plate is caused to translate linearly across the top of said housing.

13. The apparatus of claim 12 further comprising means on said binding mounting plates to temporarily and removably receive binding means.

14. The apparatus of claim 13 further comprising means to indicate linear separation of said first and second binding mounting plates and rotational angle of each of said first and second binding mounting plates.

15. The apparatus of claim 10, wherein said means for separately and independently rotating said first and second binding mounting plates and for linearly translating said movable plate and said first binding mounting plate relative to said second binding mounting plate comprise electric motors having independent control means whereby linear translation of said movable plate and said first binding mounting plate, rotation of said first binding mounting plate and rotation of said second binding mounting plate are independently actuatable.

16. The apparatus of claim 15 further comprising means on said first and second binding mounting plates to temporarily and removably receive binding means.

17. The apparatus of claim 16 further comprising means to indicate the distance of linear separation of said first and second binding mounting plates and the rotational angle of each of said first and second binding mounting plates.

18. The apparatus of claim 17 wherein said electric motors directly drive said first and second binding mounting plates and said movable plate through speed reduction gearing.

19. The apparatus of claim 17 wherein said electric motors are operably connected to said first and second binding mounting plates and to said movable plate by transmission means whereby rotation of shafts of said motors is conveyed to said first and second binding mounting plates and is transferred to linear motion of said movable plate.

20. A method for determining a custom fit stance for a user of a board-type conveyance having foot bindings thereon and for determining correct placement of said bindings on said conveyance for said user, comprising:

providing an apparatus comprising a housing having top, bottom, front, back and side walls defining a space within, leveling means extending downward from the bottom of said housing and an anti-slip surface on the top of said housing; at least one plate linearly translatable across a portion of the top of said housing and having a first binding mounting plate separately radially rotatable thereon; a second binding mounting plate spaced from said linearly translatable mounting plate and radially rotatable relative to said housing and separate and independent of said first binding mounting plate; means for separately and independently rotating said first binding mounting plate and said second binding mounting plate and means for linearly translating said movable plate and said first binding mounting plate relative to said second binding mounting plate, determining said user's leading foot, temporarily securing a set of foot bindings for a board-type conveyance to said binding mounting plates, placing said user's feet into said bindings, while said user is standing on said apparatus, adjusting the rotational angle of each of said first and second binding mounting plates and the linear separation of said first and second binding mounting plates relative to said user's lower body physiology, whereby abnormal stress and rotation of the user's legs is reduced or eliminated, determining the particular angle of rotation for each foot and the linear separation therebetween, and transferring said angles and separation to said board-type conveyance whereby said bindings are removed from said apparatus and mounted on said boardtype conveyance at the indicated angle and separation.

* * * * *